US007093780B1

(12) United States Patent
Chung

(10) Patent No.: US 7,093,780 B1
(45) Date of Patent: Aug. 22, 2006

(54) SHOWER HEAD

(75) Inventor: Chin-Tang Chung, Changhua Hsien (TW)

(73) Assignees: Shong I Copper Ltd., Changhua Hsien (TW); National Craft Industries Inc., Taipei Hsien (TW)

( * ) Notice: Subject to any disclaimer, the term of this patent is extended or adjusted under 35 U.S.C. 154(b) by 0 days.

(21) Appl. No.: 11/158,132

(22) Filed: Jun. 21, 2005

(51) Int. Cl.

| | |
|---|---|
| ***B05B 15/08*** | (2006.01) |
| ***B05B 1/02*** | (2006.01) |
| ***B05B 1/14*** | (2006.01) |
| ***B05B 1/00*** | (2006.01) |

(52) U.S. Cl. ..... 239/587.1; 239/548; 239/553.3; 239/558; 239/590.3; 239/596; 239/600

(58) Field of Classification Search ..... 239/587.1, 239/548, 553.3, 558, 590.3, 596, 600, 499, 239/556, 557, 559, 589, 587.3, 587.4
See application file for complete search history.

(56) References Cited

U.S. PATENT DOCUMENTS

| | | | | |
|---|---|---|---|---|
| 1,561,275 | A * | 11/1925 | Page | 239/558 |
| 1,721,945 | A * | 7/1929 | Cornelius | 239/559 |
| 2,874,001 | A * | 2/1959 | Webb | 239/533.14 |
| 6,241,166 | B1 | 6/2001 | Overington et al. | 239/553.3 |

* cited by examiner

*Primary Examiner*—David A. Scherbel
*Assistant Examiner*—Darren Gorman
(74) *Attorney, Agent, or Firm*—Alan D. Kamrath; Nikolai & Mersereau, P.A.

(57) ABSTRACT

A shower head includes a main body, a locking seat, a locking nut, a water outlet faceplate, an O-ring, an adjusting bolt, and a connecting unit. Thus, the water outlet faceplate is moved toward the main body by rotation of the adjusting bolt, so that the O-ring is closely urged between the water outlet faceplate and the main body, thereby forming a closely sealing effect. In addition, the water outlet faceplate is integrally formed with the locking sleeve, thereby decreasing costs of fabrication, and thereby simplifying the process of assembly.

17 Claims, 5 Drawing Sheets

SHOWER HEAD

BACKGROUND OF THE INVENTION

1. Field of the Invention

The present invention relates to a shower head, and more particularly to a shower head, wherein the water outlet faceplate is integrally formed with the locking sleeve, thereby decreasing costs of fabrication.

2. Description of the Related Art

A conventional shower head in accordance with the prior art is disclosed in U.S. Pat. No. 6,241,166. However, the conventional shower head has a complicated construction, thereby increasing costs of fabrication and assembly. In addition, when the bolt 38 is rotated to pull the bush 42 and the upper wall 8 upward to press the sealing ring 16, the upper wall 8 is easily deformed to reduce its diameter, thereby forming a clearance between the upper wall 8 and the spray plate 10 so that the shower head easily produces leak.

SUMMARY OF THE INVENTION

In accordance with the present invention, there is provided a shower head, comprising a main body having a closed upper portion and an open lower portion, a locking seat secured on the upper portion of the main body and having an upper portion protruding outward from the main body and a lower end formed with a mounting portion, a water outlet faceplate mounted on the lower portion of the main body and having a central portion formed with a threaded locking sleeve, and an adjusting bolt rotatably mounted in the locking seat and having a distal end extended through the mounting portion of the locking seat and screwed into the locking sleeve of the water outlet faceplate.

The primary objective of the present invention is to provide a shower head, wherein the water outlet faceplate is moved toward the main body by rotation of the adjusting bolt, so that the O-ring is closely urged between the water outlet faceplate and the main body, thereby forming a closely sealing effect.

Another objective of the present invention is to provide a shower head, wherein the user only needs to rotate the adjusting bolt to move the water outlet faceplate toward the main body, thereby facilitating the user adjusting the tension between the water outlet faceplate and the main body.

A further objective of the present invention is to provide a shower head, wherein the water outlet faceplate is integrally formed with the locking sleeve, thereby decreasing costs of fabrication, and thereby simplifying the process of assembly.

A further objective of the present invention is to provide a shower head, wherein the resting portion of the main body is pressed inward by the tapered stop edge of the water outlet faceplate, thereby preventing the main body from being expanded outward, and thereby preventing the main body from being detached from the water outlet faceplate.

A further objective of the present invention is to provide a shower head, wherein the water outlet faceplate is a single piece, so that the water outlet faceplate is worked easily during the electrically plating process, thereby enhancing the quality of production.

A further objective of the present invention is to provide a shower head, wherein the water outlet faceplate is removed from the main body by unscrewing the adjusting bolt, thereby facilitating the user cleaning the water outlet holes of the water outlet faceplate.

A further objective of the present invention is to provide a shower head, wherein the water is directly injected outward from the water outlet holes of the water outlet faceplate for use with a user, so that the shower head is operated smoothly.

Further benefits and advantages of the present invention will become apparent after a careful reading of the detailed description with appropriate reference to the accompanying drawings.

DETAILED DESCRIPTION OF THE INVENTION

Figure 1:
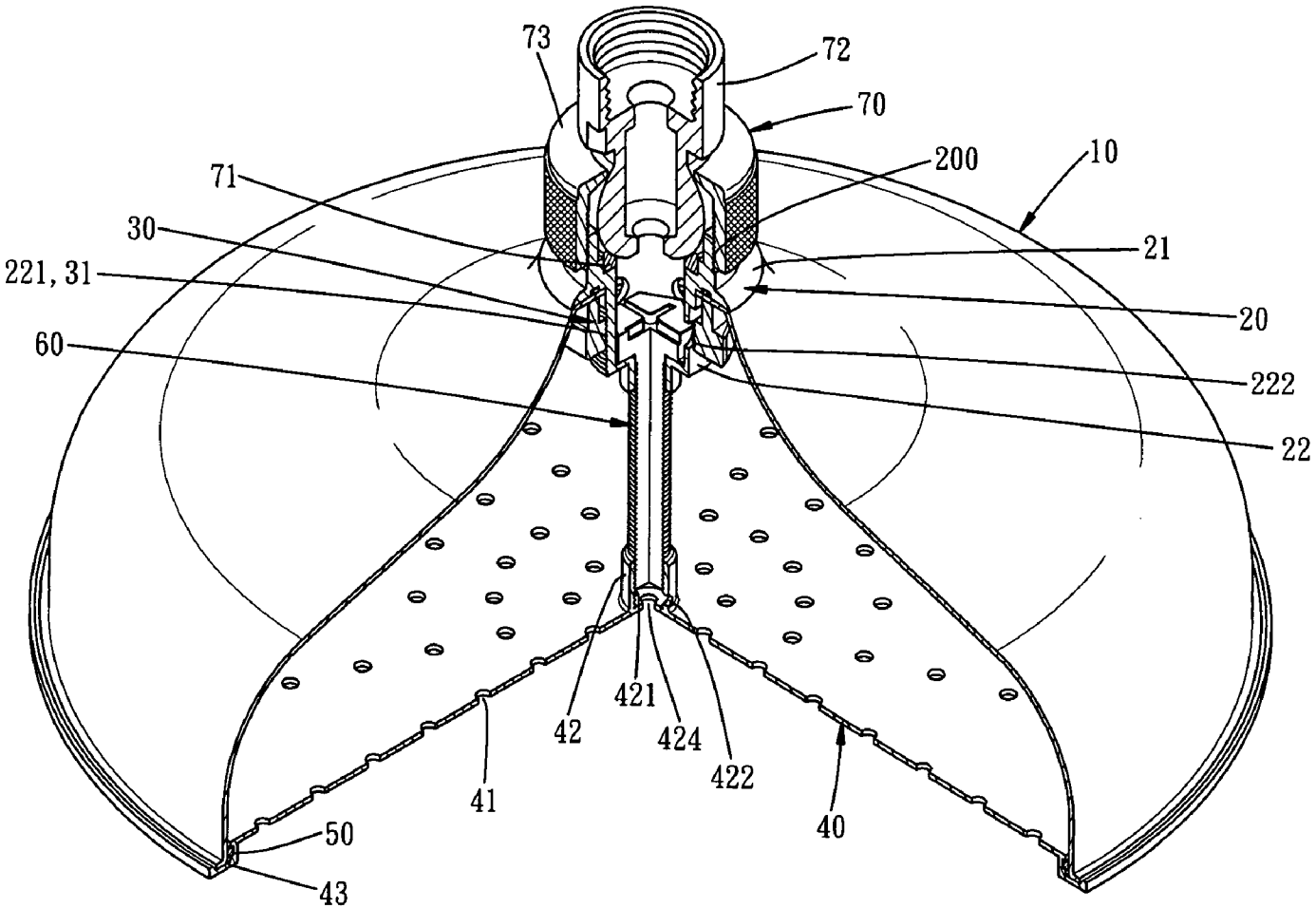
FIG. 1 is a partially cut-away perspective cross-sectional view of a shower head in accordance with the preferred embodiment of the present invention.
Figure 2:
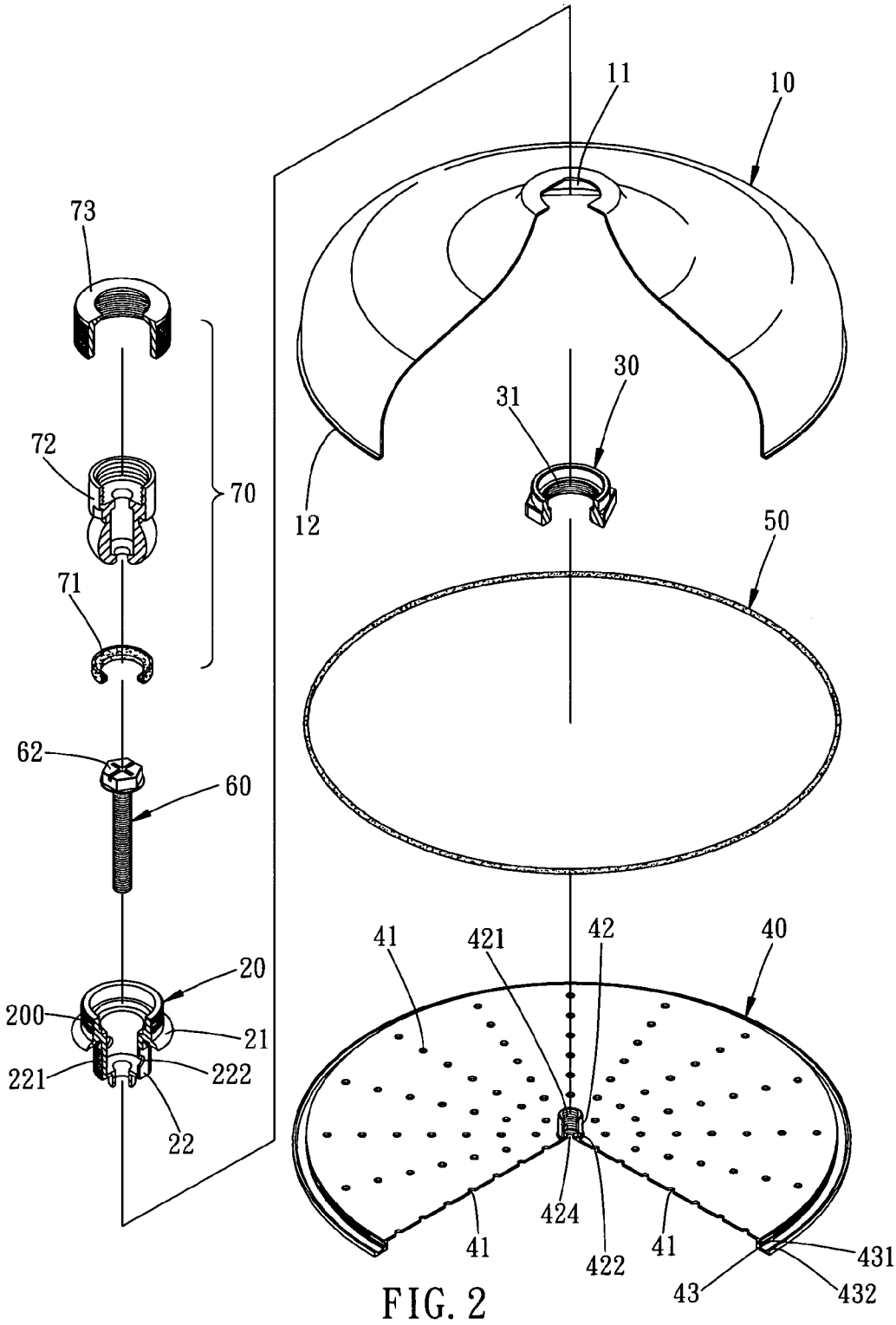
FIG. 2 is an exploded perspective view of the shower head as shown in FIG. 1.
Figure 3:
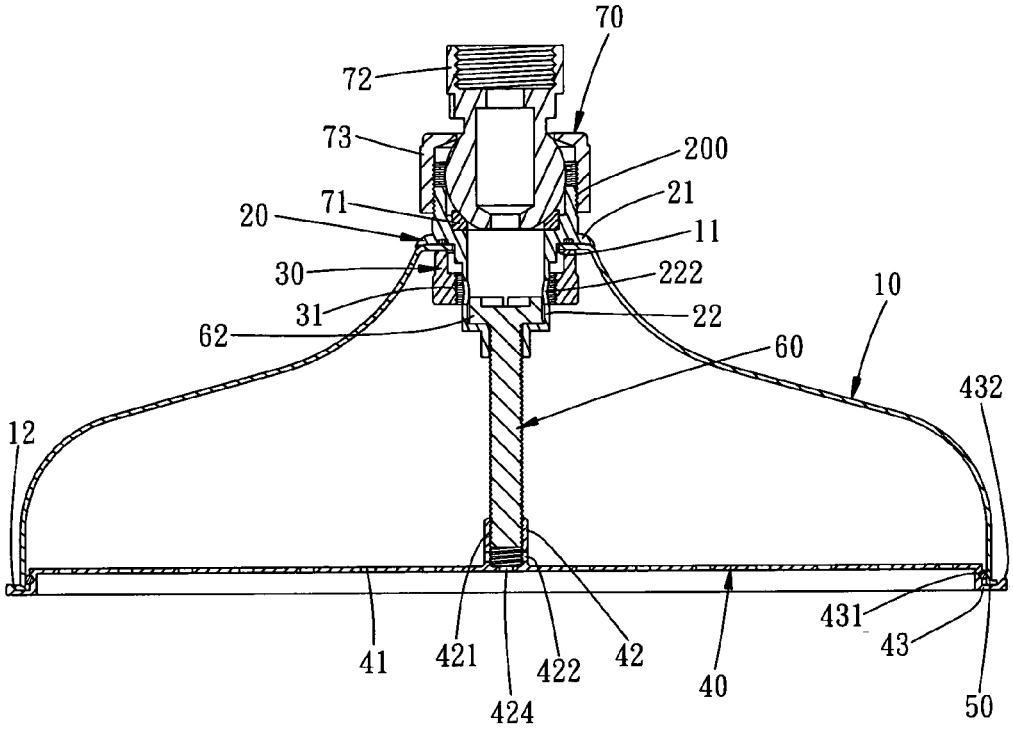
FIG. 3 is a plan cross-sectional view of the shower head as shown in FIG. 1.
Figure 4:
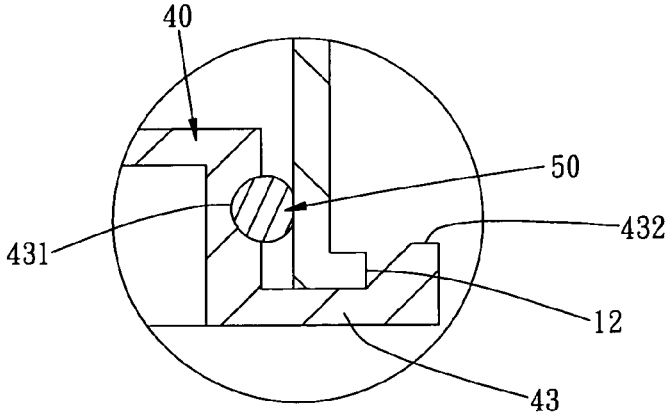
FIG. 4 is a locally enlarged view of the shower head as shown in FIG. 3.

Referring to the drawings and initially to FIGS. 1–4, a shower head in accordance with the preferred embodiment of the present invention comprises a main body 10, a locking seat 20, a locking nut 30, a water outlet faceplate 40, an O-ring 50, an adjusting bolt 60, and a connecting unit 70.

The main body 10 has a hollow inside and has a closed upper portion formed with a substantially oblong shaped positioning hole 11 and an open lower portion having a periphery formed with an outward extended resting portion 12.

The locking seat 20 is secured on the upper portion of the main body 10 and has an upper portion protruding outward from the main body 10, a lower end formed with a mounting portion 22 secured in the positioning hole 11 of the main body 10 and a mediate portion formed with an outward extended substantially arc-shaped resting flange 21 rested on the upper portion of the main body 10. The upper portion of the locking seat 20 is formed with an outer thread 200, and the mounting portion 22 of the locking seat 20 is formed with an outer thread 221. The mounting portion 22 of the locking seat 20 has a flattened face formed with at least one water inlet hole 222 communicating with an inside of the locking seat 20 and the inside of the main body 10.

The locking nut 30 is secured on the mounting portion 22 of the locking seat 20 and rested on the upper portion of the main body 10 to secure the locking seat 20 on the upper portion of the main body 10. The locking nut 30 is located in the main body 10 and formed with an inner thread 31 screwed onto the outer thread 221 of the mounting portion 22 of the locking seat 20.

The water outlet faceplate 40 is mounted on the main body 10 and has a surface formed with a plurality of water outlet holes 41 communicating with the inside of the main body 10. The water outlet faceplate 40 is secured on the lower portion of the main body 10 and has a central portion formed with a threaded locking sleeve 42 and a periphery formed with an outward extended limit portion 43 rested on the resting portion 12 of the main body 10. The locking sleeve 42 of the water outlet faceplate 40 is formed with an inner thread 421. The locking sleeve 42 of the water outlet faceplate 40 has a bottom formed with a water outlet hole 424 and has a periphery formed with a through hole 422. The limit portion 43 of the water outlet faceplate 40 is substantially L-shaped and has an upright section formed with an annular groove 431 and a transverse section formed with a tapered stop edge 432 to limit the resting portion 12 of the main body 10.

The O-ring 50 is mounted between the limit portion 43 of the water outlet faceplate 40 and the lower portion of the main body 10 and located in the annular groove 431 of the limit portion 43 of the water outlet faceplate 40.

The adjusting bolt 60 is rotatably mounted in the locking seat 20 and has a distal end extended through the mounting portion 22 of the locking seat 20 and screwed into the inner thread 421 of the locking sleeve 42 of the water outlet faceplate 40. The adjusting bolt 60 has a bolt head 62 rotatably mounted in the mounting portion 22 of the locking seat 20 and rested on a stepped bottom of the mounting portion 22 of the locking seat 20.

The connecting unit 70 is detachably mounted on the upper portion of the locking seat 20 and includes a universal connector 72 rotatably mounted in the upper portion of the locking seat 20, a gasket 71 mounted between the universal connector 72 and the upper portion of the locking seat 20, and an urging nut 73 screwed onto the outer thread 200 of the upper portion of the locking seat 20 and urged on the universal connector 72.

In assembly, the distal end of the adjusting bolt 60 is screwed into the inner thread 421 of the locking sleeve 42 of the water outlet faceplate 40 so that when the adjusting bolt 60 is rotated relative to the locking sleeve 42 of the water outlet faceplate 40, the locking sleeve 42 of the water outlet faceplate 40 is moved axially toward the main body 10 by rotation of the adjusting bolt 60. Thus, the limit portion 43 of the water outlet faceplate 40 is rested on the resting portion 12 of the main body 10, and the resting portion 12 of the main body 10 is pressed inward by the tapered stop edge 432 of the limit portion 43 to press the O-ring 50, so that the O-ring 50 is closely urged between the water outlet faceplate 40 and the main body 10, thereby forming a closely sealing effect.

When in use, the universal connector 72 of the connecting unit 70 is connected to a wall pipe to introduce the water from the wall pipe into the locking seat 20. Then, the water flows through the water inlet hole 222 of the locking seat 20 into the inside of the main body 10 and is injected outward from the water outlet holes 41 of the water outlet faceplate 40 for use with a user.

Accordingly, the water outlet faceplate 40 is moved toward the main body 10 by rotation of the adjusting bolt 60, so that the O-ring 50 is closely urged between the water outlet faceplate 40 and the main body 10, thereby forming a closely sealing effect. In addition, the user only needs to rotate the adjusting bolt 60 to move the water outlet faceplate 40 toward the main body 10, thereby facilitating the user adjusting the tension between the water outlet faceplate 40 and the main body 10. Further, the water outlet faceplate 40 is integrally formed with the locking sleeve 42, thereby decreasing costs of fabrication, and thereby simplifying the process of assembly. Further, the resting portion 12 of the main body 10 is pressed inward by the tapered stop edge 432 of the water outlet faceplate 40, thereby preventing the main body 10 from being expanded outward, and thereby preventing the main body 10 from being detached from the water outlet faceplate 40. Further, the water outlet faceplate 40 is a single piece, so that the water outlet faceplate 40 is worked easily during the electrically plating process, thereby enhancing the quality of production. Further, the water outlet faceplate 40 is removed from the main body 10 by unscrewing the adjusting bolt 60, thereby facilitating the user cleaning the water outlet holes 41 of the water outlet faceplate 40. Further, the water is directly injected outward from the water outlet holes 41 of the water outlet faceplate 40 for use with a user, so that the shower head is operated smoothly.

Figure 5:
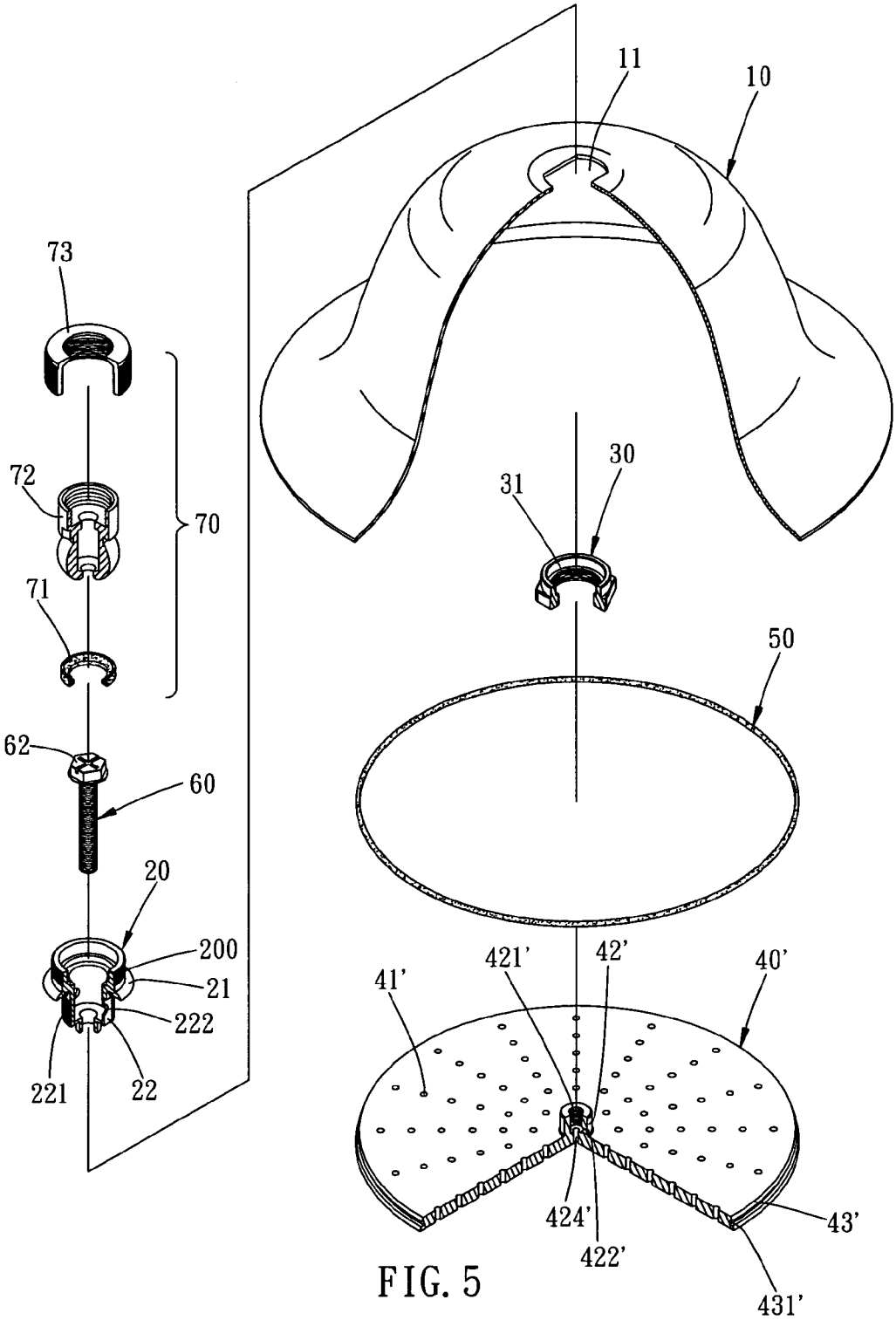
FIG. 5 is an exploded perspective view of a shower head in accordance with another preferred embodiment of the present invention.
Figure 6:
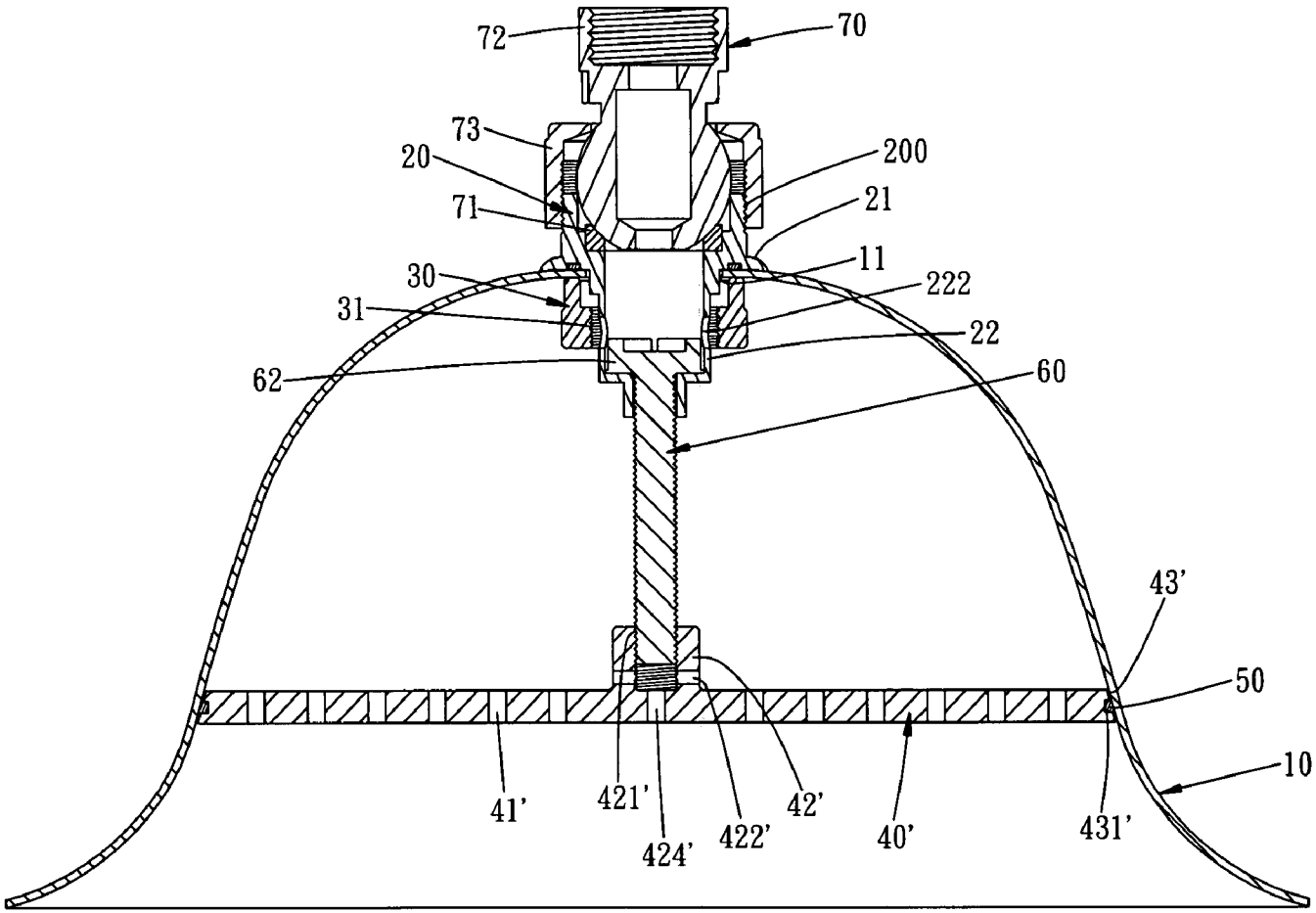
FIG. 6 is a plan cross-sectional assembly view of the shower head as shown in FIG. 5.

Referring to FIGS. 5 and 6, the water outlet faceplate 40' is secured in the lower portion of the main body 10 and has a surface formed with a plurality of water outlet holes 41' communicating with the inside of the main body 10. The water outlet faceplate 40' has a central portion formed with a threaded locking sleeve 42' and has a periphery formed with a tapered resting face 43' rested on an inner face of the lower portion of the main body 10. The locking sleeve 42' of the water outlet faceplate 40' is formed with an inner thread 421'. The locking sleeve 42' of the water outlet faceplate 40' has a bottom formed with a water outlet hole 424' and has a periphery formed with a through hole 422'. The resting face 43' of the water outlet faceplate 40' has a periphery formed with an annular groove 431'.

The O-ring 50 is mounted between the resting face 43' of the water outlet faceplate 40' and the lower portion of the main body 10 and located in the annular groove 431' of the resting face 43' of the water outlet faceplate 40'.

The adjusting bolt 60 is rotatably mounted in the locking seat 20 and has a distal end extended through the mounting portion 22 of the locking seat 20 and screwed into the inner thread 421' of the locking sleeve 42' of the water outlet faceplate 40'.

In assembly, the distal end of the adjusting bolt 60 is screwed into the inner thread 421' of the locking sleeve 42' of the water outlet faceplate 40' so that when the adjusting bolt 60 is rotated relative to the locking sleeve 42' of the water outlet faceplate 40', the locking sleeve 42' of the water outlet faceplate 40' is moved axially toward the main body 10 by rotation of the adjusting bolt 60. Thus, the resting face 43' of the water outlet faceplate 40' is rested on the inner face of the lower portion of the main body 10, so that the O-ring 50 is closely urged between the water outlet faceplate 40' and the main body 10, thereby forming a closely sealing effect.

When in use, the universal connector 72 of the connecting unit 70 is connected to a wall pipe to introduce the water from the wall pipe into the locking seat 20. Then, the water flows through the water inlet hole 222 of the locking seat 20 into the inside of the main body 10 and is injected outward from the water outlet holes 41' of the water outlet faceplate 40' for use with a user.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A shower head, comprising:

a main body having a closed upper portion and an open lower portion;

a locking seat secured on the upper portion of the main body and having an upper portion protruding outward from the main body and a lower end formed with a mounting portion;

a water outlet faceplate mounted on the lower portion of the main body and having a central portion formed with a threaded locking sleeve;

an adjusting bolt rotatably mounted in the locking seat and having a distal end extended through the mounting portion of the locking seat and screwed into the locking sleeve of the water outlet faceplate;

wherein the upper portion of the main body is formed with a substantially oblong shaped positioning hole, and the mounting portion of the locking seat is secured in the positioning hole of the main body.

2. A shower head, comprising:

a main body having a closed upper portion and an open lower portion;

a locking seat secured on the upper portion of the main body and having an upper portion protruding outward from the main body and a lower end formed with a mounting portion;

a water outlet faceplate mounted on the lower portion of the main body and having a central portion formed with a threaded locking sleeve;

an adjusting bolt rotatably mounted in the locking seat and having a distal end extended through the mounting portion of the locking seat and screwed into the locking sleeve of the water outlet faceplate;

wherein the lower portion of the main body has a periphery formed with an outward extended resting portion, and the water outlet faceplate has a periphery formed with an outward extended limit portion rested on the resting portion of the main body.

3. The shower head in accordance with claim 2, wherein the limit portion of the water outlet faceplate is substantially L-shaped.

4. The shower head in accordance with claim 2, wherein the limit portion of the water outlet faceplate has an upright section formed with an annular groove and a transverse section formed with a tapered stop edge to limit the resting portion of the main body.

5. The shower head in accordance with claim 4, further comprising an O-ring mounted between the limit portion of the water outlet faceplate and the lower portion of the main body and located in the annular groove of the limit portion of the water outlet faceplate.

6. A shower head, comprising:

a main body having a closed upper portion and an open lower portion;

a locking seat secured on the upper portion of the main body and having an upper portion protruding outward from the main body and a lower end formed with a mounting portion;

a water outlet faceplate mounted on the lower portion of the main body and having a central portion formed with a threaded locking sleeve;

an adjusting bolt rotatably mounted in the locking seat and having a distal end extended through the mounting portion of the locking seat and screwed into the locking sleeve of the water outlet faceplate;

wherein the locking seat has a mediate portion formed with an outward extended substantially arc-shaped resting flange rested on the upper portion of the main body.

7. The shower head in accordance with claim 1, wherein the mounting portion of the locking seat has a flattened face formed with at least one water inlet hole communicating with an inside of the locking seat and the inside of the main body.

8. The shower head in accordance with claim 1, wherein the water outlet faceplate has a surface formed with a plurality of water outlet holes communicating with the inside of the main body.

9. The shower head in accordance with claim 1, wherein the locking sleeve of the water outlet faceplate is formed with an inner thread, and the distal end of the adjusting bolt is screwed into the inner thread of the locking sleeve of the water outlet faceplate.

10. The shower head in accordance with claim 1, wherein the locking sleeve of the water outlet faceplate has a bottom formed with a water outlet hole and has a periphery formed with a through hole.

11. The shower head in accordance with claim 1, wherein the adjusting bolt has a bolt head rotatably mounted in the mounting portion of the locking seat and rested on a stepped bottom of the mounting portion of the locking seat.

12. The shower head in accordance with claim 1, further comprising a locking nut secured on the mounting portion of the locking seat and rested on the upper portion of the main body to secure the locking seat on the upper portion of the main body.

13. The shower head in accordance with claim 12, wherein the mounting portion of the locking seat is formed with an outer thread, and the locking nut is located in the main body and formed with an inner thread screwed onto the outer thread of the mounting portion of the locking seat.

14. The shower head in accordance with claim 1, further comprising a connecting unit detachably mounted on the upper portion of the locking seat and including a universal connector rotatably mounted in the upper portion of the locking seat, a gasket mounted between the universal connector and the upper portion of the locking seat, and an urging nut screwed onto an outer thread formed on the upper portion of the locking seat and urged on the universal connector.

15. The shower head in accordance with claim 1, wherein the water outlet faceplate is secured in the lower portion of the main body and has a periphery formed with a tapered resting face rested on an inner face of the lower portion of the main body.

16. The shower head in accordance with claim 15, wherein the resting face of the water outlet faceplate has a periphery formed with an annular groove, and the shower head further comprises an O-ring mounted between the resting face of the water outlet faceplate and the lower portion of the main body and located in the annular groove of the resting face of the water outlet faceplate.

17. The shower head in accordance with claim 1, wherein the locking sleeve of the water outlet faceplate is moved axially toward the main body by rotation of the adjusting bolt.

* * * * *